United States Patent [19]

Reen

[11] 4,415,527

[45] Nov. 15, 1983

[54] DESULFURIZATION PROCESS FOR FERROUS POWDER

[75] Inventor: Orville W. Reen, New Kensington, Pa.

[73] Assignee: Allegheny Ludlum Steel Corporation, Pittsburgh, Pa.

[21] Appl. No.: 217,292

[22] Filed: Dec. 17, 1980

[51] Int. Cl.[3] ..... B22F 1/00; C21C 1/02; C22B 1/02

[52] U.S. Cl. ..... 419/31; 419/30; 75/0.5 BA; 148/126.1; 148/16

[58] Field of Search ..... 148/16, 20.3, 126; 75/0.5 BA, 211, 224; 419/30, 31

[56] References Cited

U.S. PATENT DOCUMENTS

| | | | |
|---|---|---|---|
| 2,488,926 | 11/1949 | Mousson | 75/0.5 |
| 2,687,349 | 8/1954 | Schlecht et al. | 75/0.5 |
| 3,073,695 | 1/1963 | Silbereisen et al. | 75/0.5 |
| 3,287,181 | 11/1966 | Steverding | 148/20.3 |
| 3,325,277 | 6/1967 | Huseby | 75/0.5 |
| 3,436,802 | 4/1969 | Cohen | 75/211 X |
| 3,668,024 | 6/1972 | Johnson | 148/126 |
| 3,716,095 | 2/1971 | Ritzmann et al. | 423/DIG. 16 |
| 3,725,142 | 4/1973 | Huseby | 148/16 |
| 3,881,912 | 5/1975 | Mikurak | 75/0.5 |
| 3,954,461 | 5/1976 | Chao et al. | 75/0.5 A |

OTHER PUBLICATIONS

*The Metal—Iron,* Alloys of Iron Monographs by Cleaves and Thompson p. 69 (1935).

*Primary Examiner*—Earl C. Thomas
*Assistant Examiner*—Steven Capella
*Attorney, Agent, or Firm*—Patrick J. Viccaro

[57] ABSTRACT

A method for producing a low carbon ferrous powder melt stock with a sulfur content of less than 5 parts per million is disclosed comprising the steps of atomizing molten steel into a powder, exposing the powder to a temperature of at least 2100° F. in a hydrogen containing atmosphere until the sulfur content has been reduced to the desired level, and cooling the desulfurized powder to ambient temperature in a non-oxidizing atmosphere. During heat treatment an interconnected porosity of at least 10% is maintained for the powder.

13 Claims, No Drawings

DESULFURIZATION PROCESS FOR FERROUS POWDER

SUMMARY OF THE INVENTION

The present invention relates to a method for producing a low carbon iron or steel powder melt stock with a sulfur content of less than 5 parts per million (ppm). More specifically, the present invention is directed to a method of preparing low carbon ferrous powder melt stock with a sulfur content of less than 5 ppm by atomizing molten steel into a powder having sulfur in reducible form, heating the molten steel powder to a temperature of at least 2100° F. in a hydrogen containing atmosphere for from about one (1) to about sixty-three (63) hours to remove the majority of the reducible sulfur, and cooling the desulfurized powder in a non-oxidizing atmosphere.

Many ferrous alloys, typically require a low sulfur content to enhance their desirable properties. Such alloys may include, for example, certain expansion alloys, electrical alloys, including those used in iron-nickel soft magnetic materials. More particularly, such alloys may consist of iron-nickel alloys with 36–50% nickel, and iron (16–18%)—nickel (79–81%) molybdenum (4–5% alloys). However sulfur contents of less than about 10 ppm are seldom achieved by conventional melting methods even with the use of electrolytic iron melt stock.

Processes relying on the use of hydrogen at elevated temperatures to remove sulfur from metal are known in the prior art. However, these processes do not use a metal powder as the form of material from which the sulfur is removed. Other developments in this art disclose that heating an alloy steel powder at a moderately high annealing temperature in a hydrogen atmosphere, for other purposes, might result in a reduction in the sulfur content of the steel unit. However, these prior art processes do not have sulfur reduction as their primary purpose, nor do these prior art methods achieve the significantly low sulfur contents that are achieved by the present invention.

The prior art, such as U.S. Pat. No. 2,488,926, describes a method for the desulfurization of alloy steel grinding dust. Such process involves the steps of pulverizing the grindings to a size of between 6 mesh and 20 mesh, mixing the grindings with fuel, and sintering the mixture at a temperature of between 2700° F. and 2900° F. in air. The process is said to reduce the sulfur content from a level of between 2% and 4% to a level of about 1%.

Additional prior art references, including U.S. Pat. Nos. 2,687,349; 3,073,695; 3,325,277; 3,436,802; 3,668,024; 3,725,142; 3,881,912 and 3,954,461, disclose steel powder purification processes which include heating the steel in a gas such as hydrogen. Although the primary purpose of these processes is to produce a low carbon, low oxygen powder steel alloy, the disclosures indicate that the sulfur content of the melts may also be reduced. However, the magnitude of the incidental reduction in the sulfur content of the melts of these prior art references does not approach the magnitude of the sulfur content reduction realized by the present invention as discussed in detail below. A major reason for this difference in sulfur reduction is that the annealing temperatures and the times required for the annealing step to reduce carbon, which is the prime objective of such references, were lower than those used in the present invention. The lower temperatures and times of the prior art processes were considered necessary to prevent the powder from sintering. However, in the present invention it has been found that the powder may sinter as long as the diffusion distances remain sufficiently small to permit the free flow of hydrogen containing gas therebetween, since in a preferred embodiment, the heat treated powder of the present invention should be in a form which can be charged into a melting furnace.

Accordingly, an object of the present invention is to provide a method of producing low carbon, ferrous powder melt stock with a maximum sulfur content of about 5 ppm.

An improvement of the present invention is the production of a low carbon ferrous, iron or steel powder melt stock with a maximum sulfur content of 5 ppm by annealing a low carbon steel powder in a hydrogen containing atmosphere.

These and other objectives and advantages of this invention will be more fully understood and appreciated with reference to the following detailed description of the invention.

DETAILED DESCRIPTION OF THE INVENTION

The present invention is directed to the production of a low carbon steel powder with a sulfur content of less than 5 ppm. For the purposes of this invention, the term powder is meant to include flake particles consistent with the description of the invention herein contained. Atomized low carbon steel powder is typically produced from molten steel that has been refined in an electric furnace. Such powder may contain up to about 170 ppm sulfur. The powder, while being disposed such that an interconnected porosity between particles of about 10% or greater is maintained, may then be heated typically at a temperature of more than about 2100° F. in a hydrogen containing atmosphere for a period ranging from about 1 to about 63 hours. Such atmosphere is preferably substantially pure hydrogen but may be any gas which contains hydrogen, such as dissociated ammonia, $NH_3$, which consists of about 25% nitrogen and 75% hydrogen. It has been found that the time required for the reaction is a function of the form of the particles, and the packing density of the particles. During this process, the hydrogen in the atmosphere continues to react with the sulfur in the powder particles to form hydrogen sulfide gas. After the sulfur content of the powder reaches the desired level, the particles may be cooled, in a non-oxidizing atmosphere, to ambient temperature.

In accordance with the present invention the powder should have an average particle size less than about 0.09 inch. To the extent that the present invention applies to flake, the maximum thickness of the flake should not exceed 0.09 inch. In a preferred embodiment the average particle size of the powder (or maximum thickness of the flake) does not exceed 0.03 inch, and more preferably is from about 0.006 to about 0.03 inch. The particles may be introduced into the hydrogen containing atmosphere for example, by spreading on a conveyor belt which moves through a hydrogen containing atmosphere, by a fluidized bed wherein the hydrogen gas flows upward through the mass of powder, by allowing the particles to fall freely in an inclined rotating vessel wherein the hydrogen gas flows countercurrent to the powder as in a calcining operation, or by compacting or briquetting the material while maintaining an interconnected porosity of at least 10%.

In the latter case, the briquettes may be compacted by any known method so that they may be handled without crumbling. The briquettes must be sufficiently porous to allow the free flow of hydrogen in the hydrogen containing gas through the briquette. Preferably the smallest dimension of such briquettes should not exceed about 3 inches, and should have a density less than about 90% of the theoretical full density, and more preferably, the briquettes are cylinders having a diameter of less than about one inch and a height of less than about one-half inch and a density within the range of from about 60 to 90% of the theoretical full density. Such briquettes may be placed in a perforated metal or ceramic basket which permits the free flow of the hydrogen gas through the briquette assembly.

The following examples are illustrative of the present invention:

EXAMPLE I

Electrolytic flake iron of varying thicknesses containing 50 ppm sulfur was heated for 63 hours at 2100° F. in a hydrogen atmosphere. The resulting sulfur contents are shown in Table I below:

TABLE I

| Flake Thickness (Inches) | Sulfur-(ppm) |
|---|---|
| 0.075-0.085 | 2 |
| 0.115-0.130 | 17 |
| 0.200 | 24 |

It can be seen from the above, that short diffusion distances, i.e., flake thickness less than about 0.09 inches, are desirable.

EXAMPLE II

Atomized, low carbon steel molding grade powder, containing from 45 to 50 ppm sulfur and consisting of particles of less than 100 mesh (0.0059 inch opening), was compacted in one inch diameter molds to about 80% to 89% of the theoretical density of about 0.058 pounds per cubic inch. The compacts were heated for various lengths of time at either 2100° F. or 2200° F. The results are indicated in Table II below:

TABLE II

| Pressed Density (% of Theoretical) | Pressed Thickness (Inches) | Heating Temperature (°F.) | Heating Time (Hours) | Sulfur (ppm) |
|---|---|---|---|---|
| 80.6 | 0.321 | 2100 | 1 | 5 |
| 80.2 | 0.320 | 2100 | 3 | 3 |
| 80.8 | 0.313 | 2100 | 18 | 1 |
| 89.2 | 0.287 | 2100 | 1 | 5 |
| 89.2 | 0.289 | 2100 | 3 | 3 |
| 89.2 | 0.284 | 2100 | 18 | 1 |
| 80.3 | 0.252 | 2200 | 1 | 5 |
| 80.7 | 0.240 | 2200 | 3 | 3 |
| 81.2 | 0.235 | 2200 | 5 | 3 |
| 89.3 | 0.217 | 2200 | 1 | 4 |
| 88.8 | 0.217 | 2200 | 3 | 2 |
| 89.8 | 0.219 | 2200 | 5 | 2 |

The data in Table II above illustrates that the final sulfur content of the compact is directly proportional to the pressed density and pressed thickness and is inversely proportional to the heating time and temperature.

EXAMPLE III

In a manner similar to Example II, particles of a size between 30 mesh (0.023 inch opening) and 100 mesh (0.0059 inch opening) and containing 160 ppm sulfur were compacted to about 82% to 91% of the theoretical full density of about 0.058 pounds per cubic inch in a one inch diameter mold. The compacts were heated at temperatures of either 2100° F. or 2200° F. in a hydrogen atmosphere for various lengths of time. The results are shown in Table III below:

TABLE III

| Pressed Density (% of Theoretical) | Pressed Thickness (Inches) | Heating Temperature (°F.) | Heating Time (Hours) | Sulfur (ppm) |
|---|---|---|---|---|
| 82.2 | 0.309 | 2100 | 1 | 16 |
| 82.2 | 0.312 | 2100 | 3 | 3 |
| 80.7 | 0.311 | 2100 | 18 | 1 |
| 90.9 | 0.278 | 2100 | 3 | 11 |
| 90.9 | 0.278 | 2100 | 18 | 2 |
| 81.9 | 0.237 | 2200 | 1 | 5 |
| 83.7 | 0.230 | 2200 | 3 | 3 |
| 81.7 | 0.244 | 2200 | 5 | 2 |
| 90.7 | 0.209 | 2200 | 1 | 13 |
| 91.4 | 0.210 | 2200 | 3 | 5 |
| 90.7 | 0.209 | 2200 | 5 | 3 |

The data shows the same relationships between the variables investigated as did the result in Example II. A comparison of the results of Example II and Example III also indicates that the final sulfur content of the melt is directly proportional to the particle size.

EXAMPLE IV

Sponge iron powder containing 100 ppm sulfur was compacted to about 76% to 86% of the theoretical density of 0.058 pounds per cubic inch in a one inch diameter mold. The compacts were heated at either 2100° F. or 2200° F. for various lengths of time in a hydrogen atmosphere. The following information shown in Table IV was obtained:

TABLE IV

| Pressed Density (% of Theoretical) | Pressed Thickness (Inches) | Heating Temperature (°F.) | Heating Time (Hours) | Sulfur (ppm) |
|---|---|---|---|---|
| 76.3 | 0.330 | 2100 | 1 | 76 |
| 76.6 | 0.327 | 2100 | 3 | 61 |
| 76.8 | 0.332 | 2100 | 18 | 51 |
| 86.6 | 0.293 | 2100 | 1 | 81 |
| 85.9 | 0.292 | 2100 | 3 | 79 |
| 86.2 | 0.292 | 2100 | 18 | 75 |
| 76.6 | 0.237 | 2200 | 1 | 100 |
| 77.0 | 0.230 | 2200 | 3 | 87 |
| 76.7 | 0.244 | 2200 | 5 | 92 |
| 86.4 | 0.209 | 2200 | 1 | 89 |
| 86.7 | 0.210 | 2200 | 3 | 75 |
| 86.5 | 0.209 | 2200 | 5 | 82 |

The above example illustrates that powders such as sponge iron powder containing sulfur in a non-reducible form cannot be successfully treated by the method of the present invention.

EXAMPLE V

Low carbon atomized steel powder containing 170 ppm sulfur was roll compacted into briquettes of $\frac{3}{4}$ inch by $1\frac{1}{2}$ inch by $2\frac{1}{4}$ inch and $1\frac{1}{2}$ inch by $1\frac{7}{8}$ inch by $4\frac{1}{2}$ inch. These briquettes were compacted to about 68.5% of the theoretical full density of 0.058 pounds per cubic inch.

After heating the briquettes for 72 hours at 2200° F. in a hydrogen atmosphere, the sulfur contents of the briquettes were 2 ppm and 3 ppm, respectively.

From the above examples, it will be apparent to those skilled in the art that the novel principles of the invention disclosed herein in connection with specific examples thereof will suggest various other modifications and applications of the same. It is accordingly desired that in construing the breadth of the appended claims they should not be limited to the specific examples described herein.

I claim:

1. A method of preparing ferrous powder melt stock containing a maximum of about 5 parts per million sulfur, comprising the steps of:

a. forming a molten ferrous alloy into a powder having sulfur in reducible form and having an average particle size of less than about 0.09 inch, b. while maintaining an interconnected porosity of at least 10% for the powder, exposing the powder to a temperature of at least 2100° F. in a hydrogen containing atmosphere from a time of at least about 1 hour until the sulfur content of the powder is reduced to less than or equal to about 5 parts per million to form a sintered product, and c. cooling the desulfurized powder to ambient temperature in a nonoxidizing atmosphere.

2. A method as set forth in claim 1 wherein the powder, before desulfurizing, contains 45 to 170 ppm sulfur.

3. A method as set forth in claim 1 wherein the powder is flake having a maximum thickness of less than about 0.09 inch.

4. A method as set forth in claim 2 wherein the particle size of the steel powder is less than about 0.03 inch.

5. A method as set forth in claim 2 wherein the particle size of the steel powder is from about 0.006 inch to about 0.03 inch.

6. A method as set forth in claim 1 wherein the hydrogen containing atmosphere is substantially pure hydrogen.

7. A method as set forth in claim 1 wherein the hydrogen containing atmosphere is dissociated ammonia.

8. A method as set forth in claim 1 wherein the interconnected porosity of at least 10% is maintained by distributing the powder in loose form over a conveyor belt passing through a furnace.

9. A method as set forth in claim 1 wherein the interconnected porosity of at least 10% is maintained by fluidizing the steel powder.

10. A method as set forth in claim 1 wherein the interconnected porosity of at least 10% is maintained by tumbling the powder in a rotary kiln.

11. A method as set forth in claim 1 wherein the interconnected porosity of at least 10% is maintained by compressing the powder into briquettes, at least one dimension of which does not exceed 3 inches, said briquettes having a density of less than about 90% of the theoretical full density.

12. A method as set forth in claim 6 wherein the density of the briquettes is from 60 to 90% of theoretical full density.

13. A method as set forth in claim 6 wherein the briquettes comprise cylinders having a diameter of less than about 1 inch and a height of less than about ½ inch.

* * * * *